US006371007B1

(12) United States Patent
Ootsuki

(10) Patent No.: US 6,371,007 B1
(45) Date of Patent: Apr. 16, 2002

(54) SWASH PLATE TYPE COMPRESSOR WITH A LUBRICATED SHOE-AND-SOCKET PISTON JOINT

(75) Inventor: Yoshitaka Ootsuki, Gunma (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/531,667

(22) Filed: Mar. 20, 2000

(30) Foreign Application Priority Data

Mar. 25, 1999 (JP) ..... 11-080912

(51) Int. Cl.[7] ..... F01B 3/00
(52) U.S. Cl. ..... 92/71; 92/159
(58) Field of Search ..... 92/71, 154, 159; 91/499

(56) References Cited

U.S. PATENT DOCUMENTS

| | | | | |
|---|---|---|---|---|
| 1,714,145 | A | | 5/1929 | Sperry |
| 1,839,592 | A | | 1/1932 | Reynolds |
| 2,821,932 | A | | 2/1958 | Lucien |
| 3,712,759 | A | | 1/1973 | Olson, Jr. |
| 3,761,202 | A | | 9/1973 | Mitchell |
| 3,958,901 | A | | 5/1976 | Drevet |
| 4,236,878 | A | | 12/1980 | Terauchi |
| 4,263,814 | A | | 4/1981 | Takaoka et al. |
| 4,329,913 | A | | 5/1982 | Nakayama et al. |
| 4,522,112 | A | | 6/1985 | Nomura |
| 4,568,252 | A | | 2/1986 | Hattori et al. |
| 4,586,876 | A | | 5/1986 | Kato et al. |
| 4,641,570 | A | | 2/1987 | Futamura et al. |
| 4,662,267 | A | | 5/1987 | Kaku et al. |
| 4,712,982 | A | | 12/1987 | Inagaki et al. |
| 4,734,014 | A | * | 3/1988 | Ikeda et al. ..... 92/71 |
| 4,752,191 | A | | 6/1988 | Onomura et al. |
| 4,781,539 | A | | 11/1988 | Ikeda et al. |
| 4,893,993 | A | | 1/1990 | Shimizu |
| 5,131,319 | A | | 7/1992 | Ono et al. |
| 5,483,867 | A | | 1/1996 | Ikeda et al. |
| 5,495,789 | A | | 3/1996 | Ogura et al. |
| 5,615,599 | A | * | 4/1997 | Terauchi ..... 92/71 |
| 5,752,809 | A | | 5/1998 | Makino et al. |
| 5,772,406 | A | | 6/1998 | Takai |
| 5,868,556 | A | * | 2/1999 | Unemura ..... 92/71 |
| 5,950,521 | A | | 9/1999 | Fukushima et al. |

FOREIGN PATENT DOCUMENTS

| | | |
|---|---|---|
| FR | 1104109 | 11/1955 |
| FR | 1184849 | 7/1959 |
| FR | 1195324 | 11/1959 |
| IT | 0538013 | 1/1956 |
| JP | 49-065509 | 6/1974 |
| JP | 49-085509 | 6/1974 |
| JP | 52-169106 | 12/1977 |
| JP | 55-114888 | 9/1980 |
| JP | 56-138474 | 10/1981 |
| JP | 61-135990 | 6/1986 |
| JP | 10-220354 | 8/1998 |

* cited by examiner

*Primary Examiner*—Edward K. Look
*Assistant Examiner*—Igor Kershteyn
(74) *Attorney, Agent, or Firm*—Baker Botts L.L.P.

(57) ABSTRACT

In a swash plate type compressor having a shoe interposed between a swash plate and a concave surface of a piston, the concave surface has a first and a second spherical surface which are adjacent to and offset from each other to make a slight step extending along the concave surface. The shoe has a spherically convex surface received in the concave surface. In a condition where the spherically convex surface is received in the concave surface, the slight step serves to cause a small gap between the spherically convex surface and a part of the first spherical surface. When the swash plate is rotated together with a rotary shaft, the shoe converts a rotation of the swash plate into a reciprocating motion of the piston.

9 Claims, 3 Drawing Sheets

SWASH PLATE TYPE COMPRESSOR WITH A LUBRICATED SHOE-AND-SOCKET PISTON JOINT

BACKGROUND OF THE INVENTION

The present invention relates to a swash plate type compressor and, more particularly, to a piston joint of the same.

A conventional swash plate type compressor comprises a rotary shaft, a swash plate rotatable together with the rotary shaft, a reciprocatable piston, and a piston joint for coupling the piston with the swash plate. The piston joint usually includes a socket connected integral with the piston and a pair of shoes (for example, see Japanese Unexamined Patent Publications Nos. S61-135990, S49-65509, and S56-138474). The socket has concave surfaces opposite to each other. The swash plate is inserted between the concave surface of the socket. The shoes are interposed between the swash plate and the concave surfaces, respectively. Each of the shoes has a flat surface slidable relative to the swash plate and a convex surface opposite to the flat surface and slidable relative to the concave surface.

During the compressor is operative, the shoes wobble inside the socket of the piston in accordance with the rotation of the swash plate. Therefore, it is desired to keep sufficient lubrication between the convex surfaces of the shoes and the concave surfaces of the socket. Such lubrication can be attained by a mist of lubricating oil contained in refrigerant gas within the compressor being introduced between the convex surfaces of the shoes and the concave surfaces of the socket.

Conventionally, the convex surfaces of the shoes and the concave surfaces of the socket are designed to be substantially same to each other in radius of curvature (for example, see Japanese Unexamined Patent Publication No. H10-220354). With this structure, there is substantially no clearance between the convex surfaces of the shoes and the concave surfaces of the socket. Therefore, a mist of lubricating oil is hardly introduced between the convex surfaces of the shoes and the concave surfaces of the socket. This may affect the- retention of the sufficient lubrication between the convex surfaces of the shoes and the concave surfaces of the socket so as to wear the sliding surfaces to widen clearance.

SUMMARY OF THE INVENTION

It is therefore an object of the present invention to provide a swash plate type compressor in which lubricating oil can be sufficiently supplied between convex surfaces of shoes and concave surfaces of a socket.

Other objects of the present invention will become clear as the description proceeds.

According to the present invention, there is provided a swash plate type compressor which comprises a rotary shaft, a swash plate rotatable together with the rotary shaft, a piston, and a shoe interposed between the swash plate and the piston for converting the rotation of the swash plate into a reciprocating motion of the piston, the shoe having a spherically convex surface, the piston having a concave surface for receiving the spherically convex surface, the concave surface having a first and a second spherical surface which are adjacent to and offset from each other to make a slight step extending along the concave surface.

DESCRIPTION OF PREFERRED EMBODIMENT

Figure 1:
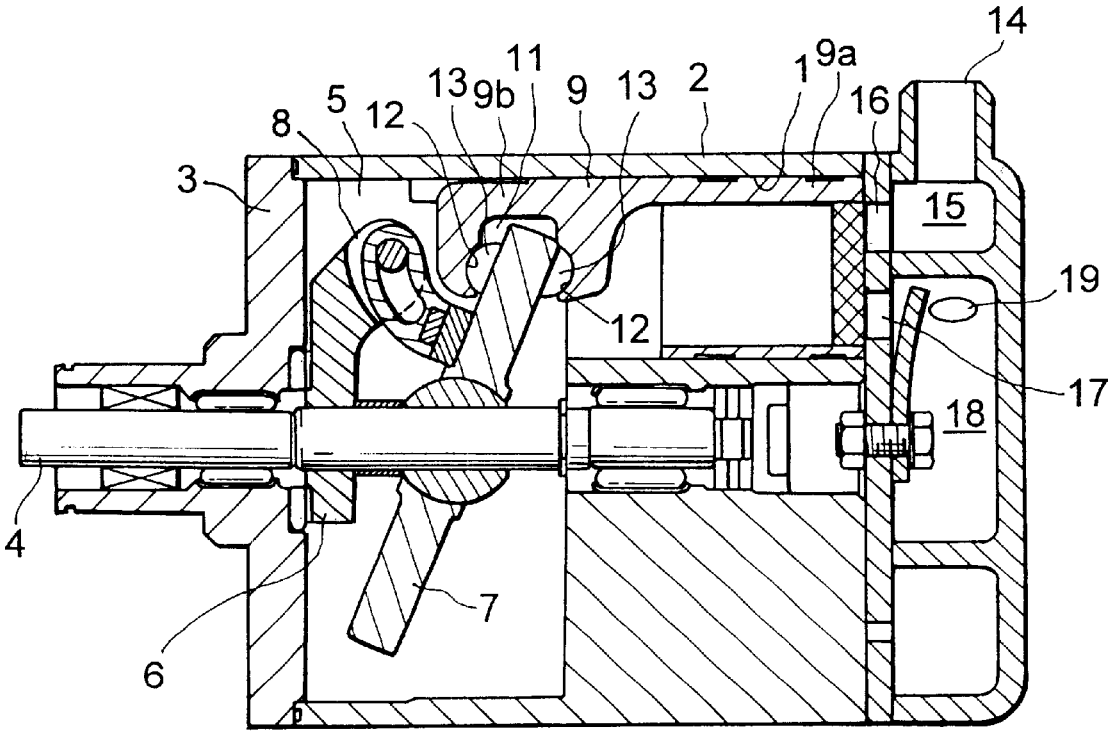
FIG. 1 is a longitudinal sectional view of a swash plate type compressor according to an embodiment of the present invention.

Referring to FIG. 1, description will be made as regards a swash plate type compressor according to an embodiment of the present invention.

The swash plate type compressor is for use in a vehicle air conditioner and comprises a cylinder block 2 and a front housing 3 connected to a front portion of the cylinder block 2. The cylinder block 2 has at its rear end portion a plurality of cylinder bores 1 disposed at equal circumferential intervals. A rotary shaft 4 is rotatably supported by the cylinder block 2 and the front housing 3.

The cylinder block 2 and the front housing 3 cooperate to define a crank chamber 5 in which a rotor 6 and a swash plate 7 are disposed. The rotor 6 is fixed to the rotary shaft 4 so as to rotate together with the rotary shaft 4. The swash plate 7 is connected to the rotor 6 by a hinge mechanism 8 so as to have variable angle relative to the rotary shaft 4. It is to be noted that the swash plate 7 also rotates together with the rotary shaft 4.

The swash plate type compressor further comprises a piston 9 having a piston body 9*a* at its one end side. The piston body 9*a* is inserted in each cylinder bore 1 in such a manner that the piston body 9*a* can axially slide relative to the cylinder bore 1. The piston 9 has a socket 9*b* at the other end side thereof. The socket 9*b* has a plate receiving groove 11 formed in the socket 9*b* in which a portion of the peripheral portion of the swash plate 7 is arranged. The plate receiving groove 11 is defined between a pair of opposite surface or walls and has concave surfaces 12 which are formed on the opposite surfaces or walls, respectively.

The swash plate type compressor further comprises a pair of shoes 13 which are interposed between the swash plate 7 and the concave surfaces 12, respectively. During the rotation of the swash plate 7, the shoes 13 slide along the swash plate 7 and are pressed in the axial direction, thereby converting the rotation of the swash plate 7 into a linear reciprocating motion of the piston 9 within the cylinder bore 1. The stroke of the piston 9 is variable in accordance with the angle of the swash plate 7 relative to the rotary shaft 4. Herein, a combination of the socket 9*b* and the shoes 13 will be called a piston joint.

When the piston 9 reciprocates within the cylinder bore 1, refrigerant gas flows into a inlet chamber 15 through an inlet port 14, is sucked into the cylinder bore 1 through an inlet opening 16, and then is discharged to a discharge chamber 18 through a discharge opening 19 and flows out through a discharge port 19. In the manner known in the art, a cooling circuit is connected between the inlet port 14 and the outlet port 19. The cooling circuit is for providing air conditioning action in the vehicle. It should be understood that the refrigerant gas usually contains refrigerating machine oil, i.e. lubricating oil.

Figure 2:
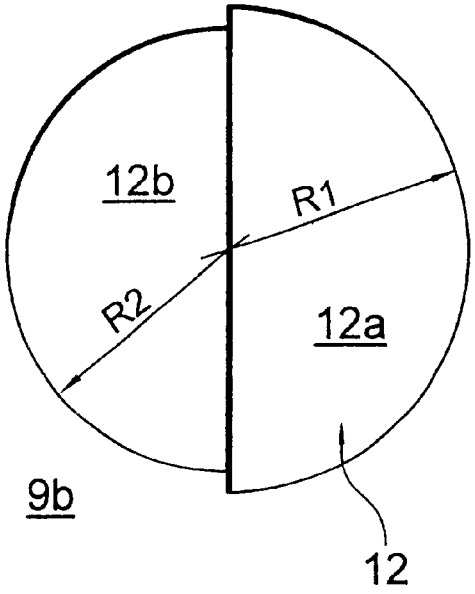
FIG. 2 is a front view showing a concave surface of a socket included in the swash plate type compressor of FIG. 1.
Figure 3:
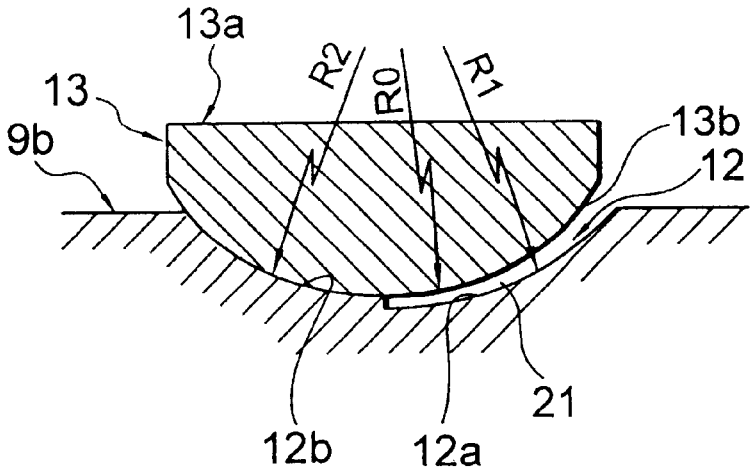
FIG. 3 is a sectional view for explaining the relation between the socket and a shoe included in the swash plate type compressor of FIG. 1.

Referring to FIGS. 2 and 3 in addition, the description will now be made as regards the piston joint.

In the piston joint, each of the shoes 13 has a flat surface 13*a* slidable relative to the swash plate 7 and a spherically convex surface 13*b* formed on the opposite side thereof. The spherically convex surface 13*b* is formed along a general spherical surface having a zeroth radius of curvature R0.

On the other hand, each of the concave surfaces 12 of the socket 9*b* is a surface consisting of a first and a second spherical surfaces 12*a* and 12*b* arranged adjacent to each other. The first spherical surface 12*a* has a first radius of curvature R1. The second spherical surface 12*b* has a second radius of curvature R2. In other words, a half of the concave surface 12 has the first radius of curvature R1 while the other half has the second radius of curvature R2. The second radius of curvature R2 is set to be substantially equal to the zeroth radius of curvature R0. The first radius of curvature R1 is set to be slightly larger than the second radius of curvature R2 only by several microns or less. As a result of difference of the first and the second radii of curvature R1 and R2, the first and the second spherical surfaces 12*a* and 12*b* are offset from each other to make a slight step extending along each of the concave surfaces 12.

It is preferable that relations among the zeroth, the first, and the second radii of curvature R0, R1, and R2 are determined as follows:

$$R2-R0 \leqq 25\ \mu m$$

and $$|R2-R1| \leqq 30\mu\ m$$

Figure 4:
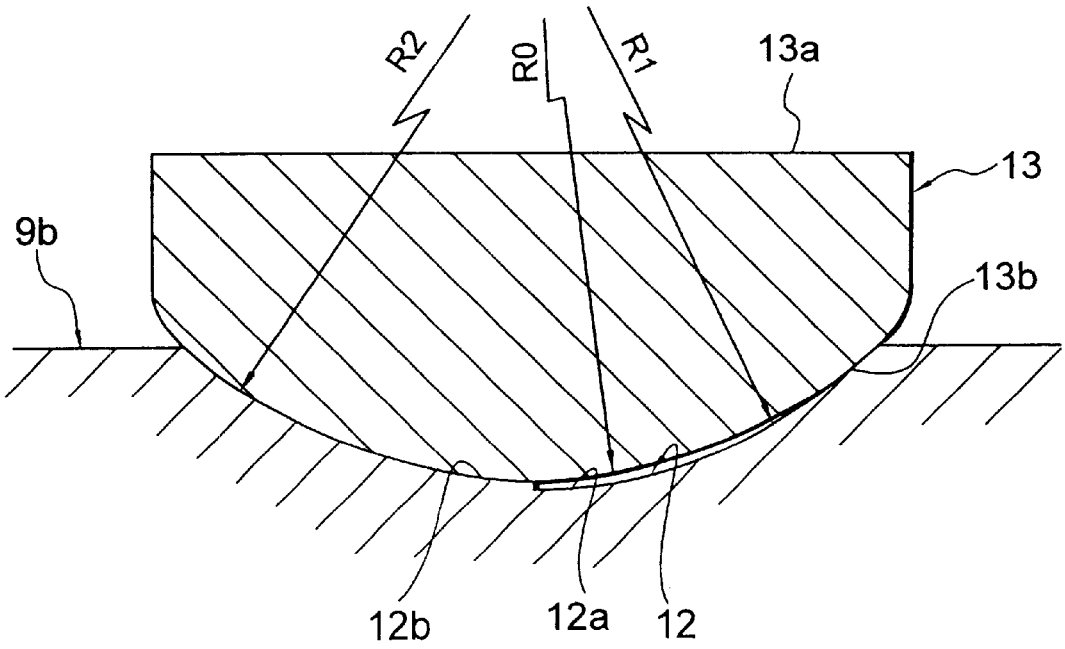
FIG. 4 is an enlarged sectional view showing the actual relation between the socket and the shoe.

When the shoe 13 is placed in the concave surface 12, the slight step causes a small gap or space 21 between the spherically convex surface 13*b* of the shoe 13 and the concave surface 12 of the socket 9*b* as shown in FIG. 3 in an exaggerated way. Since an external force is exerted, actually the concave surface 12 may be in contact with the spherical surface 13*b* substantially throughout the concave surface 12 as shown in FIG. 4. Even in this event, a very small gap or space extending along the boundary between the spherical surfaces 12*a* and 12*b* still exists.

In operation, refrigerating machine oil stuck to the swash plate 7 is supplied to the space 21 with a mist of refrigerant by means of centrifugal force developed by the rotation of the swash plate 7 so that an oil film is formed on the spherically convex surface 13*b* of the shoe 13. This keeps high lubrication between the spherically convex surface 13*b* of the shoe 13 and the concave surface 12 of the socket 19*b*, thereby preventing wear of the sliding surfaces.

While the present invention has thus far been described in connection with a single embodiment thereof, it will readily be possible for those skilled in the art to put this invention into practice in various other manners. For example, the difference between the first and the second radii of curvature may exceed several microns. The concave surface of the socket may consist of a combination of three difference radii of curvature or more. The angle of the swash plate relative to the rotary shaft may be fixed. The center of the first radius of curvature may be coincide with or may not be coincide with the center of the second radius of curvature. The second radius of the curvature may be set to be larger or smaller than the zeroth radius of curvature.

What is claimed is:

1. A swash plate type compressor comprising:

a rotary shaft;

a swash plate rotatable together with said rotary shaft;

a piston; and a shoe interposed between said swash plate and said piston for converting the rotation of said swash plate into a reciprocating motion of said piston, said shoe having a spherically convex surface, said piston having a concave surface for receiving said spherically convex surface, and said concave surface having a first and a second spherical surface which are adjacent to and offset from each other to make a slight step beginning substantially at a center portion of said concave surface and extending along said concave surface.

2. The swash plate type compressor of claim 1, wherein said first spherical surface has a first radius of curvature and said second spherical surface has a second radius of curvature and said second radius of curvature is substantially equal to a radius of curvature of said spherically convex surface.

3. The swash plate type compressor of claim 2, wherein said first radius of curvature is greater than said second radius of curvature.

4. The swash-plate type compressor of claim 2, wherein a relationship between said first radius of curvature (R1) and said second radius of curvature (R2) is determined as follows:

$$R1-R2>30\mu\ m.$$

5. The swash plate type compressor of claim 1, wherein said slight step causes a small gap between said spherically convex surface and a part of said first spherical surface, said small gap extending adjacent to said second spherical surface.

6. The swash plate type compressor of claim 1, further comprising:

a front housing; and a cylinder block comprising a front portion connected to said front housing to define a crank chamber in cooperation with said front housing and a rear portion having a cylinder bore, said piston being accommodated in said cylinder bore, said rotary shaft being supported by said front housing and said cylinder block, said swash plate being placed in said crank chamber and connected to said rotary shaft.

7. The swash plate type compressor of claim 1, wherein said piston includes a socket having a pair of opposite surfaces, said swash plate having a peripheral portion inserted between said opposite surfaces, said concave surface being formed on each of said opposite surfaces.

8. A swash type compresor comprising:

a rotary shaft;

a piston;and a shoe inter posed between said swash plate and said piston for converting the rotation of said swah plate into a reciprocating motion of said piston,said shoe having a spherically convex surface,said piston having a concave surface for reciving said spherically convex surface,and said concave surface having a first and asecond spherical surface which are adjacent to and offset front each other to make aslight step at a center portion of said concave surface and extending along said concave surface, wherein said first spherical surface has a first radius of curvature and said second spherical surface substantially equal to a radius of curvature of said spherically convex.

9. A swash plate type compressor comprising:

a rotary shaft;

a swash plate rotatable together with said rotary shaft;

a piston; and a shoe interposed between said swash plate and said piston for converting the rotation of said swash plate into a reciprocating motion of said piston, said shoe having a spherically convex surface, said piston having a concave surface for receiving said spherically convex surface, and said concave surface having a first and a second spherical surface which are adjacent to and offset from each other to make a slight step at a center portion of said concave surface and extending along said concave surface, wherein said first spherical surface has a first radius of curvature and said second spherical surface has a second radius of curvature and said first radius of curvature is greater than said second radius of curvature.

* * * * *

UNITED STATES PATENT AND TRADEMARK OFFICE

CERTIFICATE OF CORRECTION

PATENT NO. : 6,371,007 B1
DATED : April 16, 2002
INVENTOR(S) : Yoshitaka Ootsuki It is certified that error appears in the above-identified patent and that said Letters Patent is hereby corrected as shown below:

Column 4,
Line 23, please delete "R1-R2>30μm." and insert -- R1-R2>30μm --.
Line 46, please delete "a rotary shaft" and insert -- a rotary swash plate --.
Line 55, please delete "asecond spherical surface" and insert -- a second spherical surface --.
Line 56, please delete "aslightstep" and insert -- a slight step --.

Signed and Sealed this

Fourth Day of February, 2003

JAMES E. ROGAN
*Director of the United States Patent and Trademark Office*